US006453958B1

(12) United States Patent
Slavich

(10) Patent No.: US 6,453,958 B1
(45) Date of Patent: Sep. 24, 2002

(54) LOG SPLITTING DEVICE

(76) Inventor: Stefano Slavich, 332 Jules Choquet Ste-Julie, Quebec (CA), J3E 1H1

( * ) Notice: Subject to any disclaimer, the term of this patent is extended or adjusted under 35 U.S.C. 154(b) by 0 days.

(21) Appl. No.: 09/876,419

(22) Filed: Jun. 7, 2001

(51) Int. Cl.[7] ..... B27L 7/00
(52) U.S. Cl. ..... 144/195.5; 144/195.7; 144/366
(58) Field of Search ..... 83/DIG. 1; 144/193.1, 144/195.5, 195.7, 251.1, 251.2, 366, 195.4

(56) References Cited

U.S. PATENT DOCUMENTS 3,982,572 A * 9/1976 Kortendick ..... 144/195.7
4,033,390 A * 7/1977 Piontkowski ..... 144/195.7
4,280,540 A * 7/1981 Meacham ..... 144/195.5
4,354,537 A * 10/1982 Balkus ..... 144/195.5
4,391,311 A * 7/1983 Levercom ..... 144/195.7
4,429,727 A * 2/1984 Wilson ..... 144/195.5
4,905,746 A * 3/1990 Bedard ..... 144/195.7
5,704,374 A * 1/1998 Abrahamsson ..... 144/195.7

* cited by examiner

*Primary Examiner*—W. Donald Bray
(74) *Attorney, Agent, or Firm*—Eric Fincham

(57) ABSTRACT

A splitting device for splitting logs comprising a base having an upright member secured thereto, a carriage moveable along said upright member, an axe portion also moveable along said upright member and carrying an axe head, the moveable carriage being releasably secured to the axe portion, and a locking device for locking the moveable carriage in a raised position from where it can be released to split a log. The device is compact and can easily be used without requiring a great deal of strength or ability.

18 Claims, 4 Drawing Sheets

LOG SPLITTING DEVICE

FIELD OF THE INVENTION

The present invention relates to a log splitting device and more particularly, relates to a log splitting device usable by consumers.

BACKGROUND OF THE INVENTION

Wood has been used as a source of fuel for many years, both for heating and cooking purposes. Since the size of the log which can be accommodated by most wood burning appliances is limited, the logs, after being cut into appropriate lengths, must be split into smaller pieces for final use.

Originally, the splitting of the logs was accomplished through hand tools such as an axe, maul, or a hammer and wedge arrangement. While these instruments are capable of splitting a log, they require a certain amount of skill which is normally acquired through practice. However, the use of these tools is inherently dangerous and can lead to severe injury to the unskilled user. In addition, the known tools require a substantial amount of strength in order to be used properly.

There are also devices for splitting logs which are safer but are considerably more expensive and can only be justified by a higher volume user. Thus, there are a number of known hydraulically and mechanically operated log splitters which are available on the market.

As fireplaces and wood stoves have increased in popularity, there is a requirement for a relatively inexpensive and portable log splitter which can be used by an unskilled user. Such a device would overcome the disadvantages of the use of an axe wherein the lower limbs of the user are in danger of suffering serious injury and which requires a great amount of physical energy.

SUMMARY OF THE INVENTION

It is an object of the present invention to provide an inexpensive log splitting device which may be used by an unskilled and untrained user.

It is a further object of the present invention to provide a log splitting device which is effective to cut relatively large pieces of wood while requiring a minimum of effort on the part of the user.

According to one aspect of the present invention, there is provided a log splitting device which comprises a base, an upright member secured to the base, a chopping assembly which comprises a moveable carriage and an axe portion, the axe portion being moveable in a generally vertical direction along the upright member and carrying an axe head, a moveable carriage also being moveable in a generally vertical direction along the upright member and having means for releasable securement to the axe portion, and a locking device for retaining the moveable carriage in a raised position.

In a preferred embodiment of the invention, there is provided a leg guard which restricts access of the user to the area where the wood is being split. In one particularly preferred aspect of the invention, the leg guard may be repositioned so as to permit or assist in the movement of the device from one location to the other. As such, the leg guard device may have the form of a T-shaped member which, in the operative position for operation of the splitter, has a vertical member secured to an appropriate support and with a horizontal member extending outwardly to prevent access to the area proximate the axe head. For movement or transportation purposes, the horizontal member may be provided with wheels at the distal ends thereof and the entire leg guard repositioned so that it lies in a co-planer relationship with the base.

In one preferred embodiment, the axe portion comprises a bracket which is moveable along the upright member. To this end, there may be provided a bracket having bushings or bearings therein to permit smooth movement along the upright. Extending outwardly from the bracket is an arm and which carries at a distal end thereof an axe head. The axe head preferably has a slightly concave cutting edge. This shape provides for two points of contact when the axe head strikes the wood to be split. This tends to have a stabilizing action on the wood. The arm carrying the axe head preferably has a triangular configuration with an apex pointing downwardly such that the arm is configured similarly to the axe head. This reduces jamming in the logs.

The carriage, as previously mentioned, is moveable along the upright and also preferably has bushings or bearings to permit smooth movement along the upright and thereby maintain the upright in good condition. The carriage also preferably has provisions for receiving one or more weights. The amount of the weight used will determine the force exerted on the wood being split. The amount of weight can be varied depending upon the preference of the user, the type of wood and the size of the log.

The carriage has means for engagement with the upright such that it can be retained in an elevated position. This is done such that the wood can be placed in position prior to being split. Preferably, the carriage includes handle means to assist in lifting the same and conveniently, there are provided means for releasing the carriage from the raised position, the means being located proximate the handle means.

The axe portion is securable, in a releasable manner, to the moveable carriage. Preferably, there are also provided means proximate the handle to permit the engagement or disengagement of the axe portion from the carriage. The axe head is preferably of a minimum weight—the major portion of the weight being carried by the carriage to achieve maximum efficiency.

In an initial movement, the axe portion and the carriage are secured together and move to the raised position where they are held by a locking device. The wood to be split is then placed in the desired position and the releasing means operated to release the carriage and axe portion. The assembly will then move downwardly with the axe head contacting the wood. Automatically the locking device for the axe is then disarmed.

The initial blow to the wood may be sufficient to split the wood and then the whole operation is repeated with a further piece of wood. However, in the case where the force is not sufficient to split the wood on the first attempt, the axe portion remains in position with the axe head partially imbedded in the wood. The carriage assembly is then raised and released. In so doing, a second blow is struck to the axe head and the wood.

Normally, even for relatively large pieces of wood, two such blows are sufficient to split the wood. However, the blows can be repeated any number of times. An advantage of the present invention is that the axe head can be used to maintain the wood to be split in a desired position. Thus, in such a case, the axe head is not secured to the moveable carriage but can be placed in. position on top of the log or a portion thereof. The carriage can then be moved to its upper position and released to strike the axe head and split the wood. This arrangement is highly advantageous when the wood or log is not stable and/or when splitting kindling. Still further, one of the advantages of the arrangement of the present invention, when compared to the use of a conventional axe, is that when the axe is stuck in the wood, it does not have to be removed manually. Typically, when trying to split wood, the axe will become imbedded in the log and must then be removed in order that another blow is struck. With the present invention, repeated use of the carriage will split the log. This substantially reduces the physical effort which would otherwise be required.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
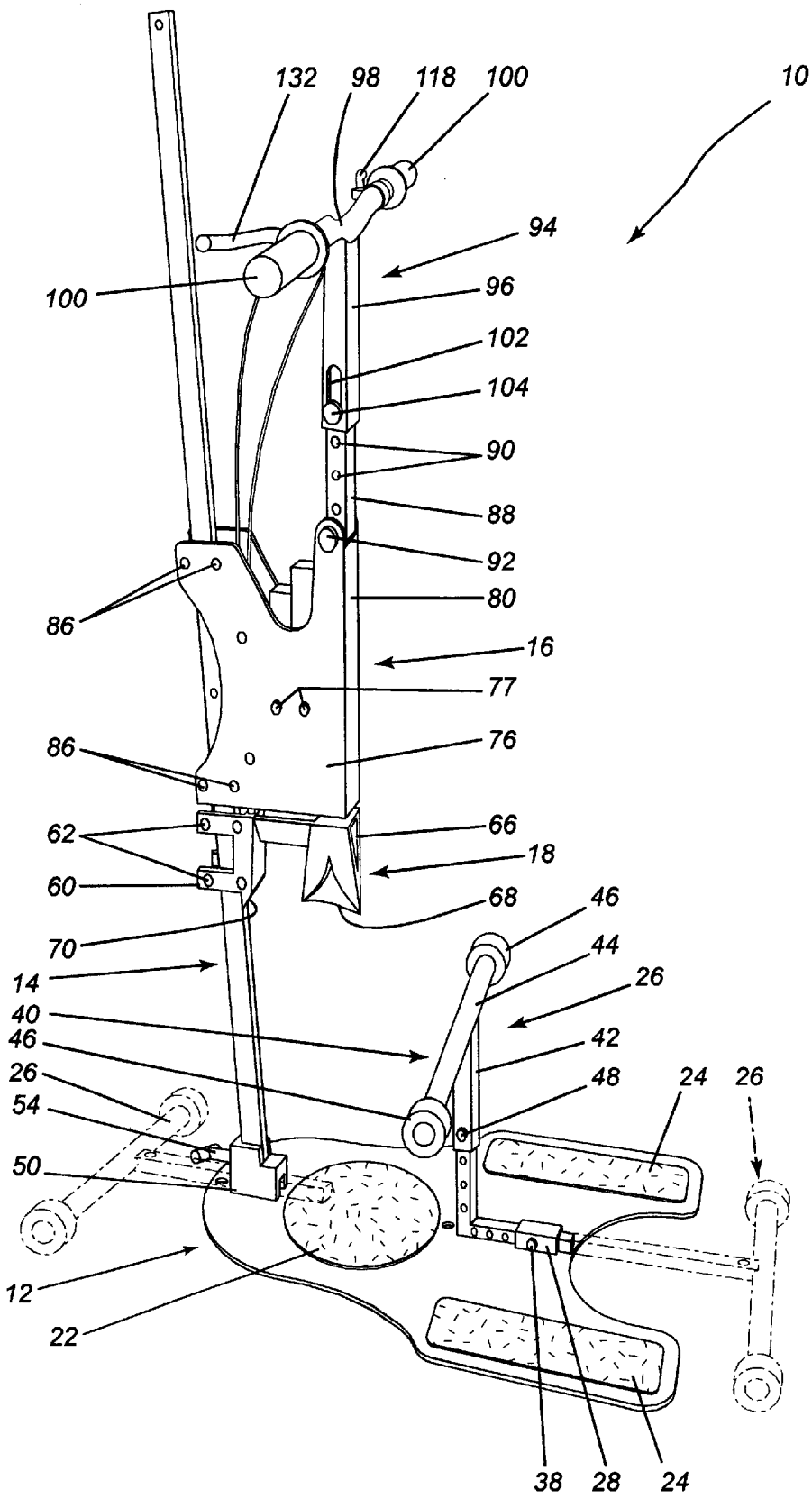
FIG. 1 is a perspective view of a log splitting apparatus according to one embodiment of the present invention.
Figure 4:
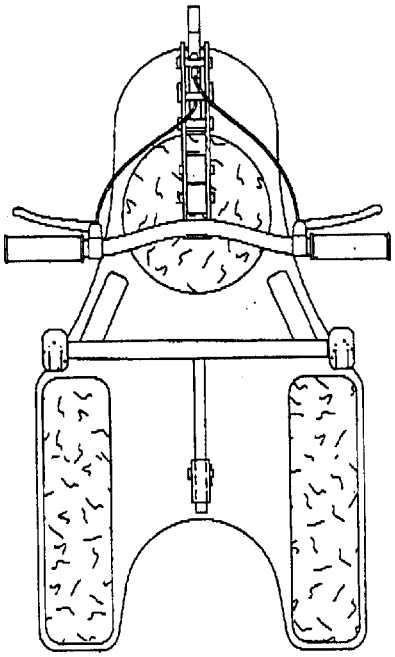
FIG. 4 is a top plan view thereof.

Referring to the drawings in greater detail and by reference characters thereto, the log splitting apparatus of the present invention is illustrated in FIG. 1 and is generally designated by reference numeral 10.

Log splitting apparatus 10 includes several different components; a base generally designated by reference numeral 12, an upright generally designated by reference numeral 14, a moveable carriage assembly generally designated by reference numeral 16, and an axe assembly generally designated by reference numeral 18.

Figure 2:
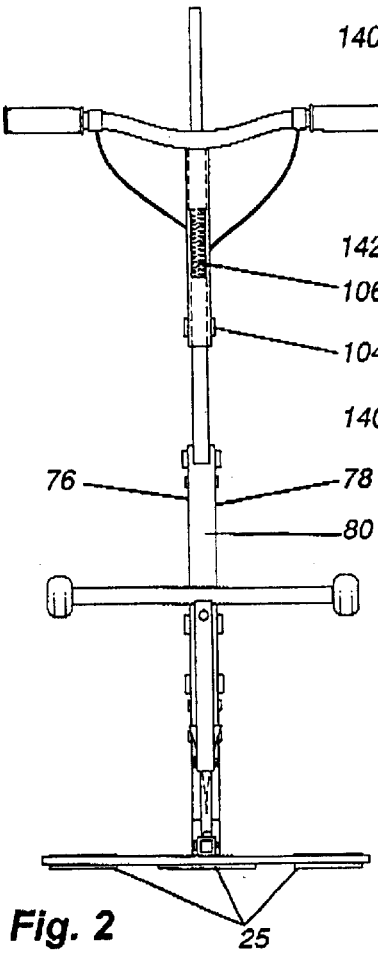
FIG. 2 is a front elevational view thereof with certain portions shown in a cut away.

In greater detail, base 12 is designed to be placed on a suitable flat substrate and includes a log receiving area 22 and first and second foot receiving areas 24. Both log receiving area 22 and foot receiving areas 24 are preferably provided with a high friction surface such that minimal slippage will occur. As may be seen in FIG. 2, base 12 also includes a plurality of feet or pads 25 such that a stable environment is provided. Preferably, three such feet or pads are present.

Log splitting apparatus 10 also includes a leg protection device generally designated by reference numeral 26 in FIG. 1. Leg protection device 26 includes a bracket 28 mounted on base 12 intermediate foot receiving areas 24. An L-shaped guard 30 has a horizontal portion 32 and a vertical portion 34 preferably formed, as shown in the illustrated embodiment, of square tubing having apertures 36 located in both vertical portion 34 and horizontal portion 32. A locking pin 38 extends through bracket 22 and one of the apertures 36 in horizontal portion 32 to lock L-shaped tubing 30 in place.

A leg guard member 40 is secured to vertical portion 34 of L-shaped guard 30 and has a general T-shaped configuration with a bottom tube 42 and a horizontal bar 44. Wheels 46 are mounted at the outer extremity of horizontal bar 44 while a locking pin 48 secures tube 42 to vertical portion 34. As may be seen from the drawings, the protection device 26 is thus adjustable both in a horizontal and vertical direction.

As may be seen in FIG. 1, base 12 includes a bracket 50 which is designed to receive upright 14. A locking key 54 is provided to secure upright 14 in a generally vertical position with respect to base 12. It will be noted that upright 14, although generally vertical, is slightly angled rearwardly with respect to base 12. An advantage of this angling along with a forward angling of the carriage component is that sufficient clearances are maintained and the system is easier to use.

Axe assembly 18 includes a bracket 60 having a plurality of bushings 62 mounted in a manner such that bracket 60 can move along upright 14. In the illustrated embodiment, four such bearing or bushing assemblies 62 are provided. Extending outwardly from bracket 60 is a support arm 64 which has an inverted triangle shape for reasons which will be discussed hereinbelow.

Similarly, as may be seen in FIG. 1, there is provided a deflector 70 which is also of a triangular configuration and is connected to the bottom of bracket 60, again for reasons discussed hereinbelow.

Figure 6:
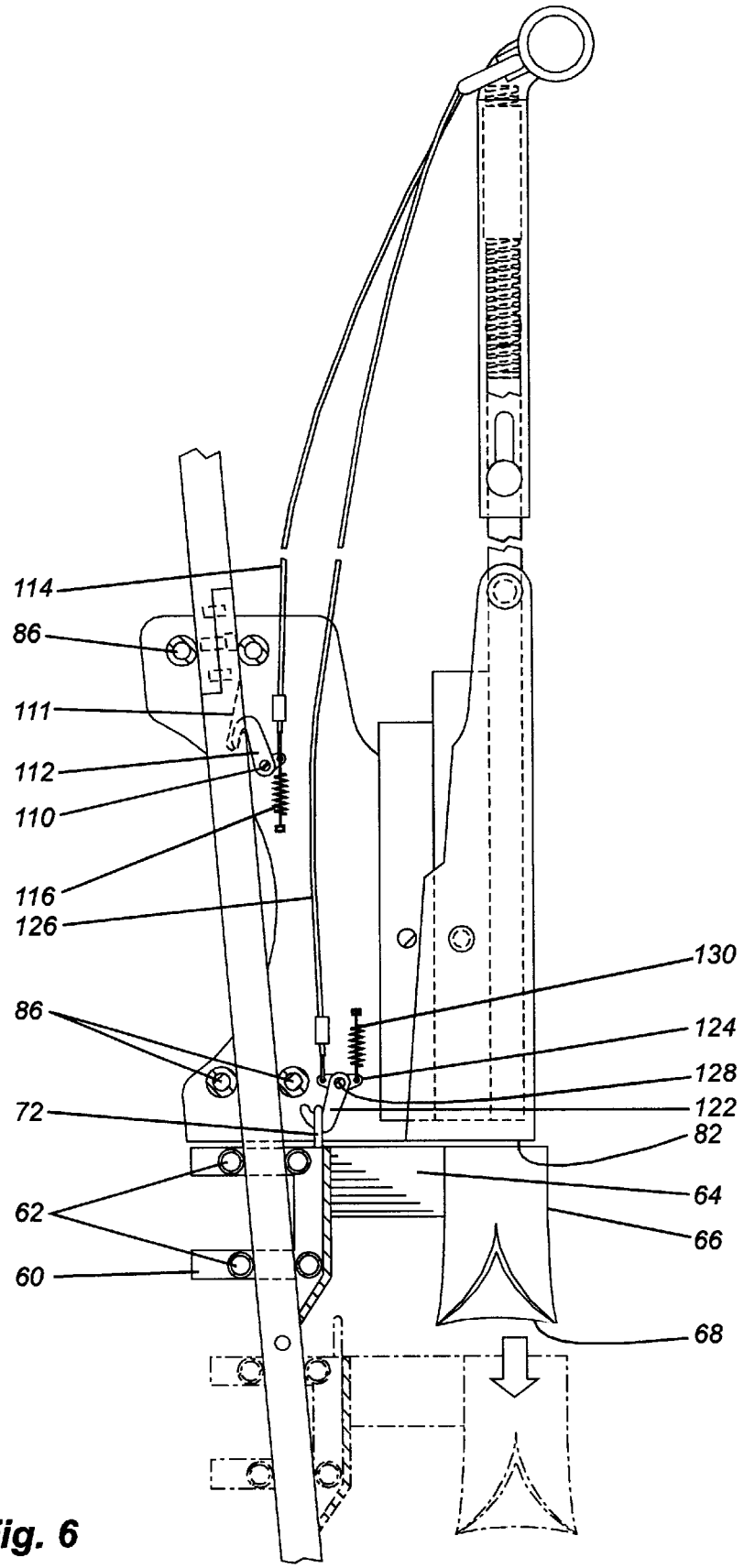
FIG. 6 is a side elevational view, partially in a cut away, of the moveable carriage and axe portion illustrating the operation thereof.

Mounted at the distal end of support arm 64 is axe head 66. As best seen in FIG. 6, axe head 66 has a cutting edge 68 which is of a slightly concave configuration. Also, axe head 66 is somewhat thinner at the central portion than the outer edges. This again provides for a better splitting action and aids when using the apparatus for kindling and smaller logs.

Also as best seen in FIG. 6, the upper portion of bracket 60 carries a grasping hook 72.

Carriage 16 has a first side wall 76, a second side wall 78 and an end wall 80 extending there between. There is also provided a bottom wall 82. To permit the carriage 16 to travel along upright 14, there are provided a plurality of bearing or bushing assemblies 86 extending between side walls 76 and 78. Bearing assemblies 86 can conveniently comprise a roller bushing mounted on a shaft such that the rollers will rotate along upright 14. In a preferred embodiment, there is provided a slight gap between the bushing and the upright so as to prevent binding.

A connecting shaft 88 extends upwardly from between side walls 76 and 78. Connecting shaft 88 is provided with a plurality of apertures 90 and is secured to carriage 16 by means of bolts 92 or equivalent locking pins.

Carriage 16 includes an upper handle portion generally designated by reference numeral 94 and which comprises a shaft 96 and a horizontal handle bar 98 having grips 100 at either extremity thereof. As may be seen in FIGS. 1 and 6, a slot 102 is formed in the side wall of shaft 96 and a bolt 104 connects shaft 96 to connecting shaft 88. A spring 106 is mounted interiorly of shaft 96 to provide a suspension or shock absorber capability thereto. The handle bar 98 may thus be adjusted to the height of the user.

In order to provide weight or mass to the carriage 16, there are provided a plurality of weights 108 which are seatable on bottom wall 82 and which are retained between side walls 76, 78. Each of the weights may be retained between side walls 76 and 78 in a fixed position by means of pins or bolts 77.

Referring to FIG. 6, there is provided a pivot pin 110 which extends between side walls 76, 78 and upon which is mounted a pivotal hook member 112. Hook member 112 is designed to engage an aperture 111 formed within upright 14 to retain carriage 16 in a raised or elevated position prior to operation. For purposes of controlling the movement, there is provided a cable 114 connected to one end of hook member 112 while a spring member 116 provides a biasing force. Cable 114 is connected to an actuator 118 situated proximate one end of horizontal handle bar 98.

Situated at the other end of horizontal handle bar 98 is a second actuator 132. Actuator 132 is connected by means of cable 126 to a hook 122. Hook 122 is engageable with grasping hook 72 by means of a member 124 and a pivot pin 128 to which hook 122 is connected. A biasing spring 130 is also provided.

In operation, carriage 16 is raised to an elevated position with hook 122 engaging grasping hook 72 of axe assembly 18. Thus, both axe assembly 18 and carriage 16 are raised to an elevated position with both actuators being pulled.

Figure 5:
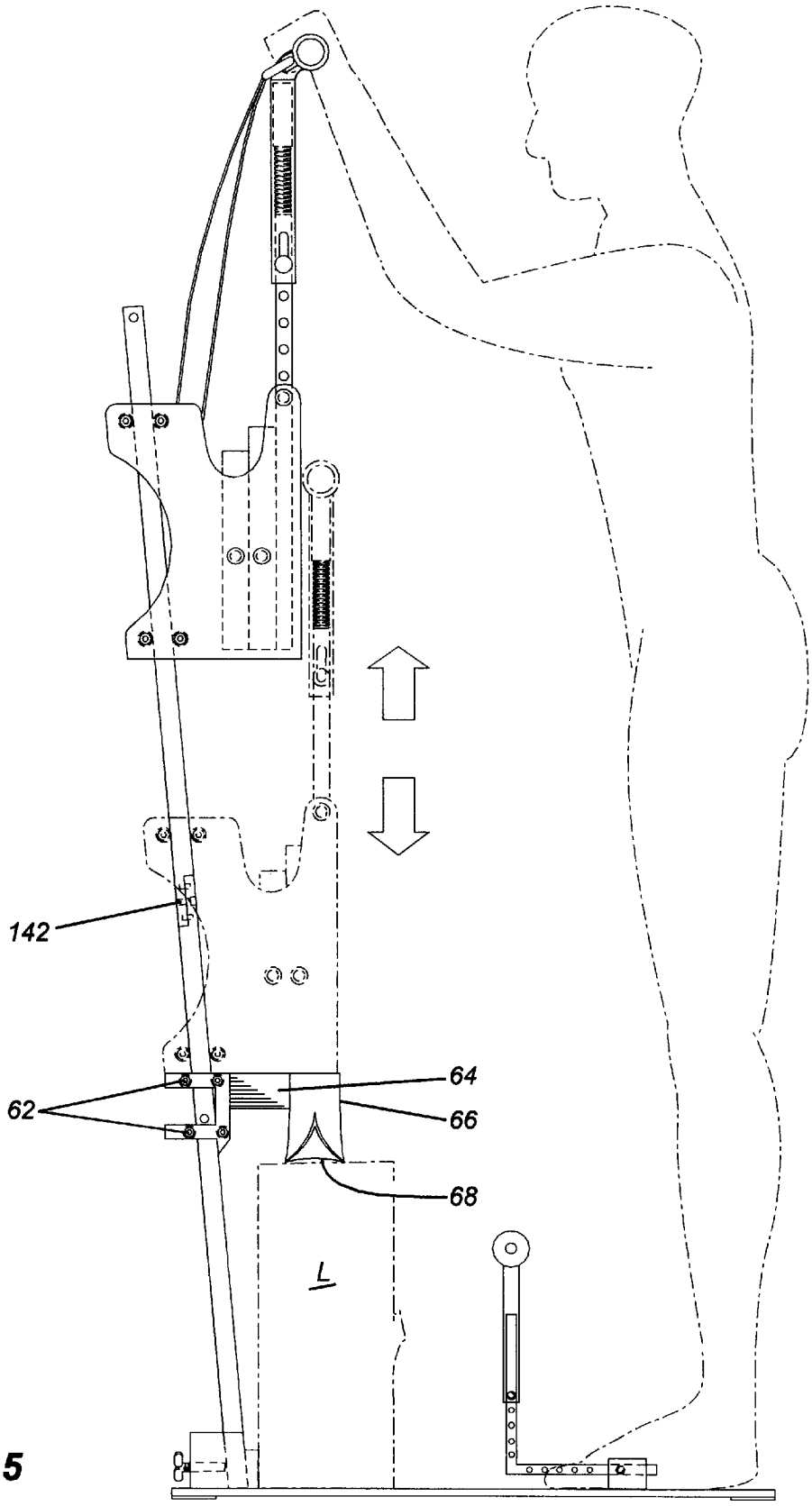
FIG. 5 is a side elevational view illustrating operation of the log splitting apparatus.

When so engaged, both carriage 16 and axe assembly 18 are retained in the elevated position as shown in FIGS. 1, 5 and 6. Subsequently, a portion of a log L (FIG. 5) is placed on a long receiving area 22 of base 12. The operator then stands in a position as shown in FIG. 5 and the carriage is raised to release hook 112. Carriage 16 and axe assembly 18 are then free to move downwardly such that axe head 66 will fall on log L.

Depending upon the size of log L, the force may or may not be sufficient to split log L. If successfully split, carriage 16 and axe assembly 18 are raised upwardly and the process repeated with a further log. However, if splitting has not been completed, carriage 16 can then be moved to an elevated position leaving axe assembly 18 in a lower position. The carriage assembly 16 is then released again to strike a second blow on the upper surface of axe head 66. This can be repeated until the log L is successfully split. In practice, most logs will require only one or two such operations although bigger logs—12–16 inches may require more than two operations.

As previously mentioned, support arm 64 has an inverted triangular configuration such that if the log is very large, support arm 64 can enter into the split wood. Similarly, deflector 70 which is of a triangular configuration or alternatively, is somewhat arcuate, prevents any wood from entering between upright 14 and bracket 60.

Also be noted, as seen in FIG. 1, that leg guard 40 can be moved to a position such that wheels 46 contact the ground and the device can then be moved from one location to another. Alternatively, bracket 50 may also include a slot to receive tube 42 whereby leg guard 40 is usable at the other end (as shown in dotted lines) for transportation of the apparatus.

Figure 3:
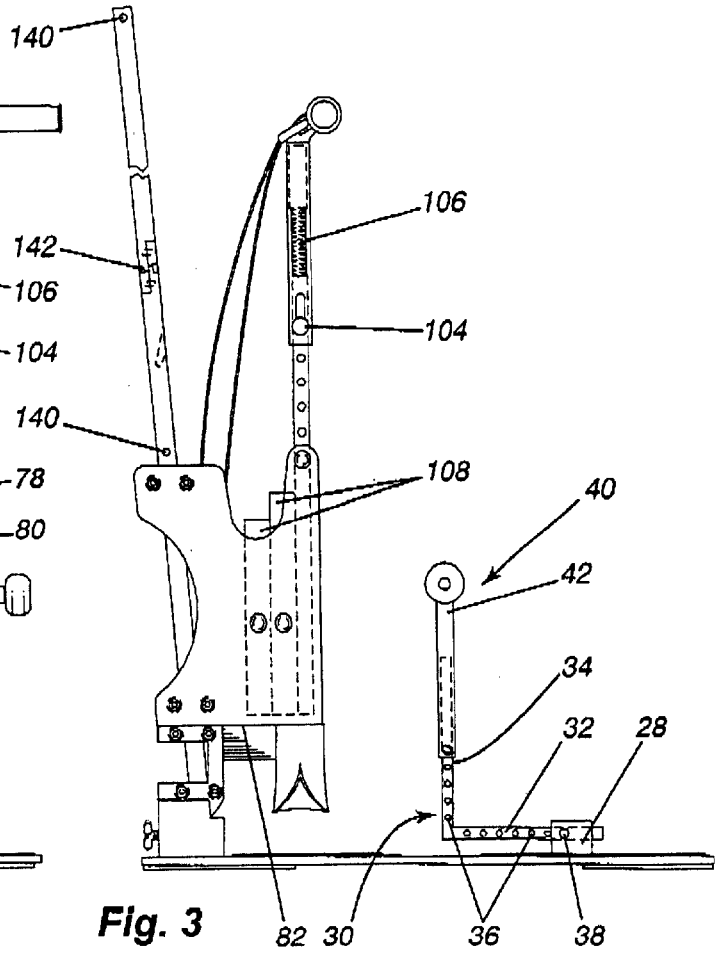
FIG. 3 is a side elevational view thereof with certain portions being shown in a cut away.

For safety purposes, a pair of apertures 140 (FIG. 3) may be provided in upright 14 to receive a member to prevent unauthorized operation of the device. Thus, the lower aperture 140 would prevent movement of the carriage and a padlock or other such member may be utilized. This would prevent children from operating the device. The upper aperture 140 would prevent removal of the carriage and/or raising the carriage too high.

Similarly, as shown in the drawings, upright 14 may be formed of two pieces connected at joint 142 for ease of transport and saving of space.

It will be understood that the above described embodiment is for purposes of illustration only and that changes or modifications may be made thereto without departing from the spirit and scope of the invention.

I claim:

1. A splitting device comprising:

a base;

an upright member secured to said base;

a chopping assembly comprising a moveable carriage and an axe portion;

said axe portion being moveable in a general vertical direction along said upright member and carrying an axe head;

said moveable carriage being moveable in a generally vertical direction along said upright member and having means for securement to said axe portion;

a locking device for retaining said moveable carriage in a raised position; and a leg guard mounted on said base for protecting the legs of a user.

2. The splitting device of claim 1 further including a high friction portion on said base for receiving a log to be split, said high friction area minimizing movement of said log.

3. The splitting device of claim 2 further including high friction areas on said base for receiving the feet of a user to thereby prevent accidental slipping.

4. The splitting device of claim 1 wherein said axe head has a cutting edge of a generally concave configuration.

5. The splitting device of claim 1 wherein said moveable carriage includes handle means to receive the hands of a user of said device.

6. The splitting device of claim 5 wherein said handle means includes means mounted thereon to operate said locking device.

7. The splitting device of claim 6 wherein said handle means includes an actuator connected to said means for releasably securing said carriage and said axe portion.

8. The splitting device of claim 1 wherein said moveable carriage includes a cavity for receiving a weight.

9. The splitting device of claim 5 further including spring shock absorber means interposed between said handle means and said carriage.

10. The splitting device of claim 1 wherein said axe portion comprises a bracket mounted on said upright for said movement in a generally vertical direction, an arm extending outwardly from said bracket, said axe being mounted at a distal end of said arm.

11. The splitting device of claim 10 wherein said arm has a generally triangular configuration with an apex thereof pointed downwardly.

12. The splitting device of claim 10 further including a deflector mounted on said carriage adjacent said upright member.

13. The splitting device of claim 1 wherein said axe portion and said moveable carriage include bushings for movement along said upright.

14. The splitting device of claim 1 wherein said leg guard includes an upright securable to said base and a horizontal member extending from said upright to prevent the legs of a user from moving towards said axe portion.

15. The splitting device of claim 14 wherein said horizontal member has wheels at opposed ends thereof whereby said leg guard can be positioned to facilitate movement of said splitting device.

16. A splitting device comprising:

a base;

an upright member secured to said base;

a chopping assembly comprising a moveable carriage and an axe portion;

said axe portion being moveable in a generally vertical direction along said upright member and carrying axe head;

said moveable carriage being moveable in a generally vertical direction along said upright member and having means for securement to said axe portion, said moveable carriage including a cavity for receiving a weight; and a locking device for retaining said moveable carriage in a raised position.

17. A splitting device comprising:

a base;

an upright member secured to said base;

a chopping assembly comprising a moveable carriage and an axe portion;

said axe portion being moveable in a generally vertical direction along said upright member and carrying an axe head;

said moveable carriage being moveable in a generally vertical direction along said upright member and having means for releasable securement to said axe portion;

an actuator connected to said means for releasably securing said carriage and said axe portions to; and a locking device for retaining said moveable carriage in a raised position.

18. The splitting device of claim 17 wherein said axe head has a cutting edge of a generally concave configuration.

* * * * *